US006931907B2

(12) United States Patent
Yuan et al.

(10) Patent No.: US 6,931,907 B2
(45) Date of Patent: Aug. 23, 2005

(54) CURVED BUILDING PANEL WITH STRESS-REDUCING APERTURES

(75) Inventors: Huang Hong Yuan, Shanghai (CN); Andre Dieduksman, Hertogenbosch (NL)

(73) Assignee: Hunter Douglas Industries BV, El Rotterdam (NL)

( * ) Notice: Subject to any disclaimer, the term of this patent is extended or adjusted under 35 U.S.C. 154(b) by 0 days.

(21) Appl. No.: 10/679,968

(22) Filed: Oct. 6, 2003

(65) Prior Publication Data

US 2004/0065038 A1 Apr. 8, 2004

Related U.S. Application Data

(63) Continuation of application No. 09/393,370, filed on Sep. 10, 1999, now Pat. No. 6,672,025.

(30) Foreign Application Priority Data

Sep. 11, 1998 (EP) ..... 98203023
Dec. 17, 1998 (EP) ..... 98204279

(51) Int. Cl.[7] ..... B21D 47/00
(52) U.S. Cl. ..... 72/379.2
(58) Field of Search ..... 72/379.2, 411

(56) References Cited

U.S. PATENT DOCUMENTS

| | | | | |
|---|---|---|---|---|
| 1,726,500 | A | 8/1929 | Norris | 52/145 |
| 2,662,743 | A | 12/1953 | Frenger | 165/56 |
| 2,729,431 | A | 1/1956 | Little | 165/56 |
| 2,870,817 | A | 1/1959 | Boldrini | 153/54 |
| 3,171,517 | A | 3/1965 | Howell | 52/86 |
| 3,295,284 | A | 1/1967 | Tschiesche | 52/506.07 |
| 3,300,923 | A | 1/1967 | Behlen | 52/245 |
| 3,390,495 | A | 7/1968 | Dalby | 52/222 |
| 3,417,530 | A | 12/1968 | Long | 52/506.08 |
| 3,461,630 | A | 8/1969 | Lovullo | 52/493 |
| 3,549,114 | A | 12/1970 | Eiermann | 248/340 |
| 3,627,194 | A | 12/1971 | Hester | 229/117.23 |

(Continued)

FOREIGN PATENT DOCUMENTS

| | | | | |
|---|---|---|---|---|
| AU | 56750/86 | | 10/1986 | |
| DE | 93 12 871 | U | 8/1993 | |
| DE | 295 14994 | U1 | 1/1996 | |
| EP | 0 339 216 | | 11/1989 | |
| EP | 0 519 068 | A1 | 12/1992 | |
| EP | 0 403 131 | | 12/1993 | |
| GB | 1395185 | | 5/1975 | |
| GB | 1 567 716 | | 5/1980 | |
| GB | 2 034 207 | * | 6/1980 | 72/379.2 |
| JP | 04118455 | | 4/1992 | |
| JP | 09302838 | A | 11/1997 | |
| WO | WO 82/04457 | | 12/1982 | |

OTHER PUBLICATIONS

Australian Patent Office Search Report dated Apr. 20, 2001 of corresponding Singapore Application No. SG 9904387–9, application filing date Sep. 8, 1999.
European Search Report dated Aug. 17, 2001 of corresponding European application No. 99307189.

*Primary Examiner*—Lowell A. Larson
(74) *Attorney, Agent, or Firm*—Dorsey & Whitney LLP

(57) ABSTRACT

A longitudinally curved building panel, such as a wall or ceiling panel, comprising upstanding lateral side flanges having a plurality of stress-reduction apertures and a mounting bracket for suspending a pair of adjacent building panels.

11 Claims, 10 Drawing Sheets

U.S. PATENT DOCUMENTS

| | | | | | |
|---|---|---|---|---|---|
| 3,814,304 | A | | 6/1974 | Hester | 229/117.23 |
| 3,904,114 | A | | 9/1975 | Kasuba | 238/349 |
| 3,971,176 | A | | 7/1976 | Rannels | 52/86 |
| 4,023,317 | A | | 5/1977 | Bettger et al. | 52/204 |
| 4,083,153 | A | | 4/1978 | Sumpter | 52/28 |
| 4,296,692 | A | | 10/1981 | Roux | 105/397 |
| 4,557,090 | A | | 12/1985 | Keller, Sr. | 52/245 |
| 4,688,310 | A | * | 8/1987 | Kelm et al. | 29/889.22 |
| 5,050,360 | A | | 9/1991 | Gailey | 52/506.06 |
| 5,115,611 | A | | 5/1992 | Lim et al. | 52/537 |
| 5,291,717 | A | | 3/1994 | Turner | 52/745.07 |
| 5,475,962 | A | | 12/1995 | Horsten et al. | 52/506.08 |
| 5,595,328 | A | | 1/1997 | Safabakhsh et al. | 228/1.1 |
| 5,625,985 | A | | 5/1997 | Johnson | 52/177 |
| 5,946,821 | A | | 9/1999 | Winheim | 34/611 |
| 6,260,402 | B1 | * | 7/2001 | Leek | 72/379.2 |

* cited by examiner

CURVED BUILDING PANEL WITH STRESS-REDUCING APERTURES

CROSS-REFERENCE TO RELATED APPLICATIONS

This application is a continuation of U.S. application Ser. No. 09/393,370, filed Sep. 10, 1999, now U.S. Pat. No. 6,672,025 which corresponds to and claims priority to European Application No. 98203023.1, filed Sep. 11, 1998, and to European Application No. 98204279.8, filed Dec. 17, 1998. Each of the above-referenced applications is hereby incorporated by reference as though fully set forth herein.

BACKGROUND OF THE INVENTION a. Field of the Invention

This invention relates to a longitudinally curved panel with upstanding flanges on its lateral sides, particularly a curved architectural ceiling or wall panel. This invention also relates to a bracket for mounting the panel.

b. Background Art

Architects often design buildings with arched ceilings to enhance the buildings' appearance. For entrance halls of conference centers, hospitals, government buildings, universities and the like, arched or multiple-curved ceilings are often specified. These ceilings can be constructed from a plurality of longitudinally curved ceiling panels, the upstanding lateral side flanges of which are connected to a supporting structure.

In making a curved, relatively thin, sheet metal ceiling panel which is longitudinally concave and/or convex, is relatively long longitudinally, and has upstanding lateral side flanges, the problem has been to combine strength, particularly for lengthwise or longitudinal stability, with cross-sectional uniformity.

In order to curve an aluminum panel with upstanding lateral side flanges to a longitudinally concave or convex configuration, an apparatus as described in EP 0 403 131 can be used. Alternatively, a modified conventional roll-form machine can be used to bend upwardly the lateral sides of a flat panel simultaneously with longitudinal curving of the panel. Other conventional metal-forming machines can also be modified to be used in this way.

Generally, aluminum panels of small lateral widths, e.g. up to 100 mm, can be curved longitudinally after their lateral sides have been bent upwardly, without damaging the panels permanently. Such longitudinally curved ceiling panels can be obtained, using an apparatus as described in EP 0 403 131. For wider panels which usually have higher lateral side flanges, it is generally necessary to provide stress-reduction features in their upstanding lateral side flanges; otherwise, the panels will be damaged when curved longitudinally. Also, the accuracy of the cross-sectional panel shape is important to allow subsequent mounting thereof on a supporting structure. An example of a conventional stress-reduction feature is a plurality of parallel slits, cut in each of the lateral sides of a metal panel, from the free edge thereof, prior to bending and curving the panel as described in DE 295 14 994 (U1). However, the upstanding lateral side flanges of the resulting longitudinally curved panel are weakened substantially by having been slit and therefore are not able to resist sufficiently deformation during transport and installation of the panel. To strengthen the slit upstanding lateral side flanges, curved flat bars or ribs or narrow sheets have been additionally fixed (e.g. by welding, gluing or riveting) to them. Although this has somewhat reduced undesirable deformation during transport and handling, the additional labor and materials costs have been considerable. Moreover, there has continued to be a need for a more uniform longitudinal curvature of the exposed panel surface, without distortions caused by the incremental nature of the slits.

BRIEF SUMMARY OF THE INVENTION

In accordance with this invention, the upstanding lateral side flanges of a longitudinally curved, building panel are provided with a plurality of stress-reduction apertures, preferably with a generally V-shape, that are advantageously relatively small and that are advantageously distributed substantially uniformly over the surface of each flange. The apertures of this invention can be advantageously punched in the lateral margins of a structural metal sheet prior to bending upwardly its lateral sides to provide it with the desired cross-sectional shape, as well as prior to providing it with the desired longitudinally-extending curved configuration. The upstanding lateral side flanges of the resulting longitudinally curved building panel are not weakened by providing them with the apertures, and therefore, they do not deform during transport and installation of the panel.

Also in accordance with this invention, a mounting bracket is provided for suspending a pair of adjacent longitudinally curved building panels of this invention from a supporting structure; the mounting bracket comprising: a pair of parallel legs; means for attaching the legs to the supporting structure; and means for clamping the side-by-side pair of flanges of the building panels together.

Further in accordance with this invention, a method is provided for making longitudinally curved building panel, comprising the steps of: providing a flat length of a structural sheet metal; punching the plurality of stress-reduction apertures in each lateral margin of the length of sheet metal; bending the length of sheet metal into a transversely profiled cross-section having two upstanding lateral side flanges incorporating the lateral margins; and longitudinally curving the transversely profiled length of sheet metal.

Still further in accordance with this invention, at least one of the upstanding lateral side flanges of the curved building panel has a bead on it which can be inwardly or outwardly turned. Advantageously, at least one lateral side flange of the curved building panel has an outwardly turned bead on it. These beads can be engaged in well-known support stringers to retain the ceiling panel in place.

Further aspects of this invention will be apparent from the detailed description below of particular embodiments and the drawings thereof.

DESCRIPTION OF THE PREFERRED EMBODIMENTS

Figure 1:
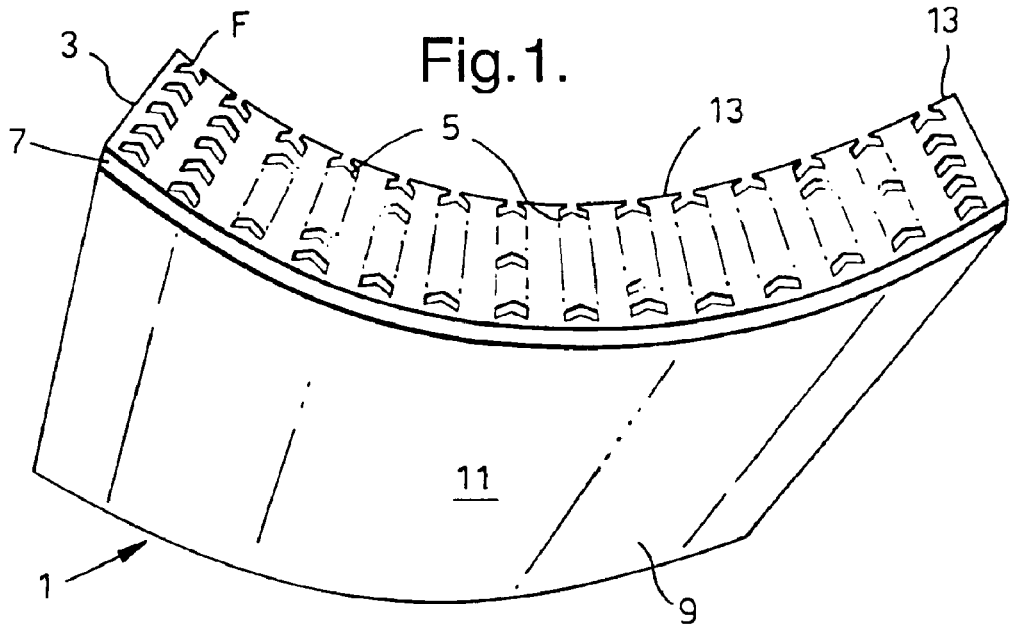
FIG. 1 is a perspective view of a first embodiment of a longitudinally-curved, upwardly concave, ceiling panel of the invention.
Figure 5:
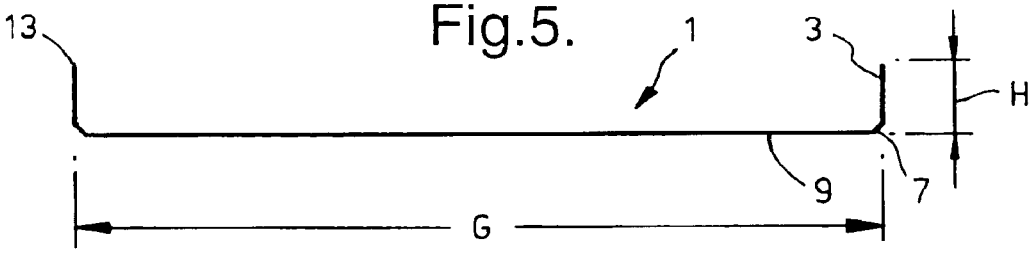
FIG. 5 is a cross-section of the ceiling panel of FIG. 1.

FIGS. 1 and 5 shows a first embodiment of an elongated, longitudinally curved, ceiling panel 1 of this invention. The ceiling panel 1 is made of sheet metal, preferably aluminum. The ceiling panel 1 has two upstanding lateral side flanges 3, only one of which is visible in FIG. 1. A plurality of stress-reduction open and closed apertures 5 or only closed apertures, each preferably with a generally V-shape, are punched out of each upstanding lateral side flange 3. The upper-most stress-reduction apertures 5 in each upstanding lateral side, as shown, are open at the top along the upper edge of the upstanding lateral side, but it is believed that this is not necessary. A bevelled edge portion 7 connects each upstanding side flange 3 to the adjacent lateral edge of a central portion 9 of the ceiling panel 1. The lower face 11 of the central portion 9 of the ceiling panel 1 will generally face the floor of the building, in which the panel is installed. Thus, the ceiling panel 1 of FIG. 1 is longitudinally upwardly concave when installed with the lower face 11 of its central portion 9 facing downwardly. However, the ceiling panel 1 can also be made so that it is longitudinally upwardly convex when installed with the lower face 11 of its central portion 9 facing downwardly.

In accordance with this invention, specific dimensions of the ceiling panel 1 are not critical. In this regard, the ceiling panel 1 of this invention can suitably have, as shown in FIG. 5 for example, a width G of up to 300 mm or more and a longitudinal length of up to about 4 meters or even more. The upstanding lateral side flanges 3 can have a height H of about 30 mm or more. The radius of curvature of the upwardly concave ceiling panel 1 (in FIG. 1) can suitably be, for example, as little as about 500 mm, whereas the radius of curvature of a corresponding upwardly convex ceiling panel is preferably about 2000 mm or more. However, optimal benefits of the invention are generally obtained when the lateral width of the ceiling panel 1 is more than about 100 mm, since it is normally possible to longitudinally curve narrower ceiling panels without providing the stress-reduction apertures 5, preferably with a generally V-shape, in their upstanding lateral side flanges. This is so because the upstanding lateral side flanges of narrower (smaller) ceiling panels usually have a smaller height which more easily accommodates elongations or length reductions caused by longitudinal bending.

Figure 2:
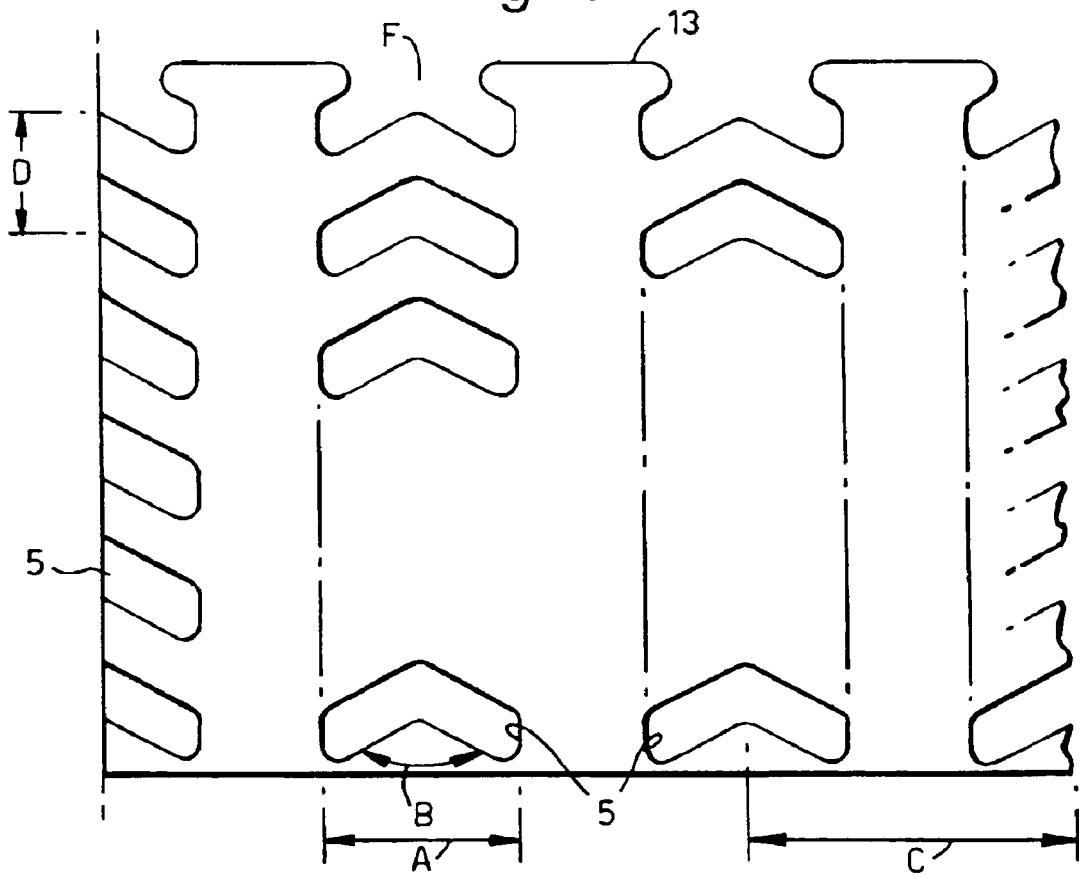
FIG. 2 is an enlarged plan view of a pattern of generally V-shaped, stress-reduction apertures in the upstanding lateral side flanges of the ceiling panel of FIG. 1.

FIG. 2 shows a pattern of generally V-shaped open and closed stress-reduction apertures 5 in the upstanding lateral side flanges 3 of the ceiling panel 1. The apertures 5 provide increased longitudinal deformability of the flanges 3 and serve to relieve the stress on the ceiling panel 1 caused by bending and curving it to its final longitudinally curved configuration. In this regard, it is believed that the apertures 5 can adapt to elongations in length where the metal of the flanges 3 is stretched and can also accommodate reductions in length where the metal of the flanges 3 is compressed. This effectively results in canceling out the forces of longitudinal curving on the metal of the entire ceiling panel 1 and forming it with a flaw-free smooth curved central portion 9.

The exact shape of the stress-reduction apertures 5 is not believed to be critical. In this regard, the generally V-shaped, stress-reduction apertures 5 can be V-shaped, Y-shaped, X-shaped, U-shaped, W-shaped, M-shaped, triangular, diamond-shaped or half-moon crescent-shaped.

The exact number, dimensions, location and spacing of the stress-reduction apertures 5 in each upstanding lateral side flange 3 is also not believed to be critical. As shown in FIGS. 1 and 2, for example, the generally V-shaped, stress-reduction apertures 5 of FIGS. 1–3 can have a longitudinal extent A of about 6 mm and be about 2 mm high and can have an inside angle B of about 120 degrees. The longitudinal spacing C between adjacent crests of the generally V-shaped apertures can be about 10 mm, and the vertical spacing D can be about 4 mm. It is preferred that each upstanding lateral side flange 3 have its stress-reduction apertures 5 arranged, as shown in FIG. 1, in a plurality of substantially parallel, vertical columns, spaced apart along the length of the flange and containing at least three, preferably at least five, apertures 5, one on top of the other. Each vertical column can have a top-most or sixth aperture 5 that is open at its top, along the top edge 13 of the upstanding flange 3 as indicated by general reference F in FIG. 2. The bottom of each vertical column of apertures 5 can extend nearly to the bottom of its side flange 3, to the bevelled edge portions 7 between its side flange 3 and the central portion 9 of the ceiling panel 1, provided the apertures are not visible when looking at the central portion of the ceiling panel, as installed.

The stress-reduction apertures 5 can also be arranged in a plurality of substantially parallel but staggered vertical columns, spaced apart along the length of the upstanding lateral side flanges 3 of the ceiling panel 1 of this invention. Similarly, the apertures 5 can be aligned in a plurality of substantially parallel, longitudinally-extending rows, evenly spaced apart along the height of each upstanding flange 3. In this regard, the number of longitudinally-extending rows of apertures 5 in each flange of the ceiling panel 1 can be reduced—without affecting significantly its rigidity—by increasing the radius of its curvature. For example, in a ceiling panel 1 with an upwardly concave curvature (as shown in FIG. 1), where five (5) rows of apertures 5 are suitable for allowing the panel to be provided with a radius of curvature equal to, or greater than, about 0.5 m: four (4) rows of apertures are suitable for allowing the panel to be provided with a radius of curvature equal to, or greater than, about 1.7 m; three (3) rows of apertures are suitable for allowing the panel to be provided with a radius of curvature equal to, or greater than, about 5 m; and two (2) rows of apertures are suitable for allowing the panel to be provided with a radius of curvature equal to, or greater than, about 32 m. Likewise in a ceiling panel 1 with an upwardly convex curvature, where five (5) rows of apertures are suitable for allowing the panel to be provided with a radius of curvature equal to, or greater than, about 1.6 m: four (4) rows of apertures are suitable for allowing the panel to be provided with a radius of curvature equal to, or greater than, about 1.8 m; three (3) rows of apertures are suitable for allowing the panel to be provided with a radius of curvature equal to, or greater than, about 2.5 m; and two (2) rows of apertures are suitable for allowing the panel to be provided with a radius of curvature equal to, or greater than, about 4.3 m.

Figure 3:
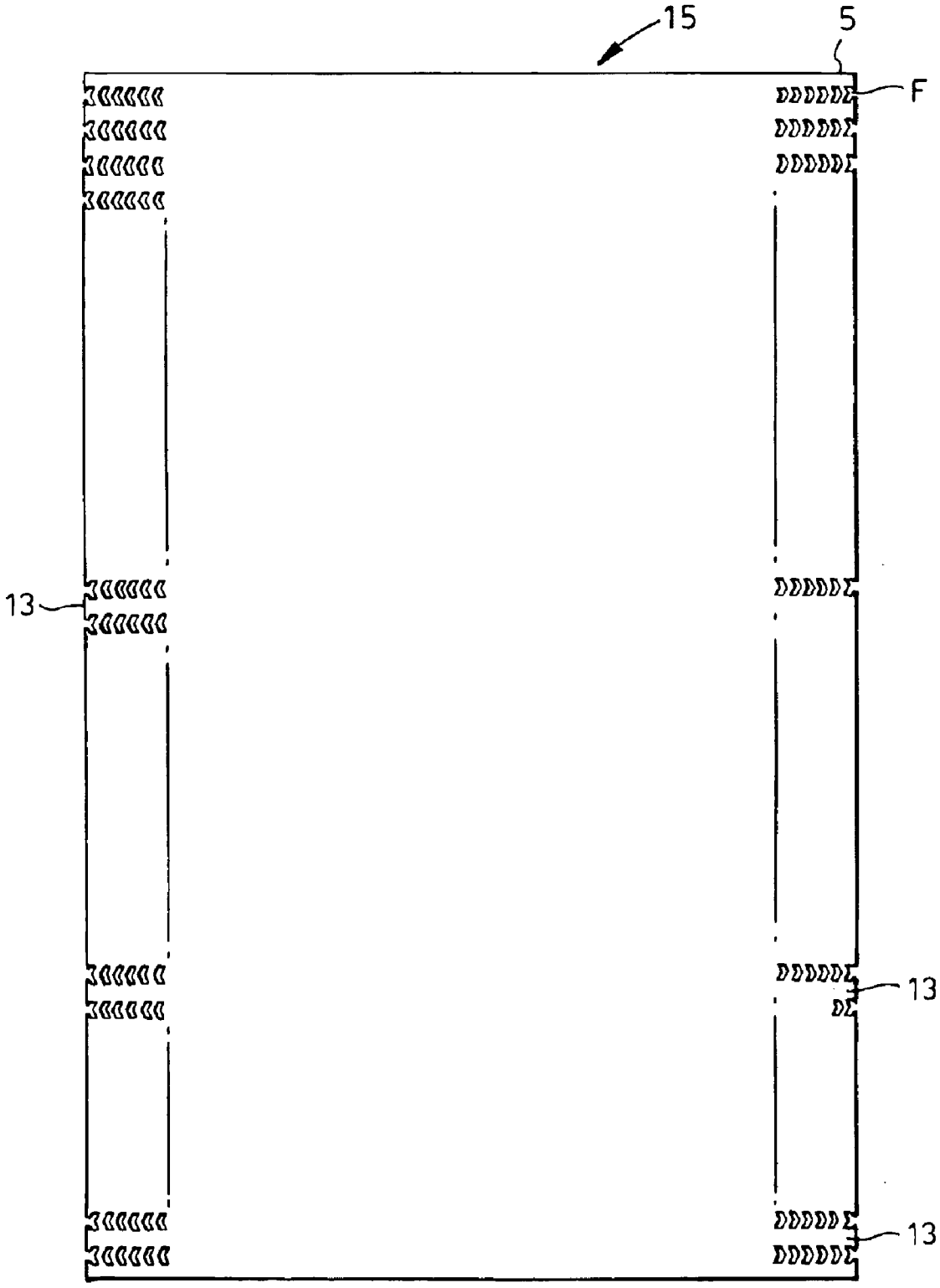
FIG. 3 is a top plan view of a metal sheet with punched-out stress-reduction apertures in its lateral margins, prior to bending and curving the sheet to form the ceiling panel of FIG. 1.

FIG. 3 shows a flat metal sheet 15 with open and closed stress-reduction apertures 5 punched in its lateral margins, prior to bending and curving the sheet 15 into the ceiling panel 1 of FIG. 1 with the transversely profiled cross-section of FIG. 5. The method used for providing the apertures 5 in the lateral margins of the metal sheet 15 is not believed to be critical, and conventional metal punching techniques can be used.

Figure 4:
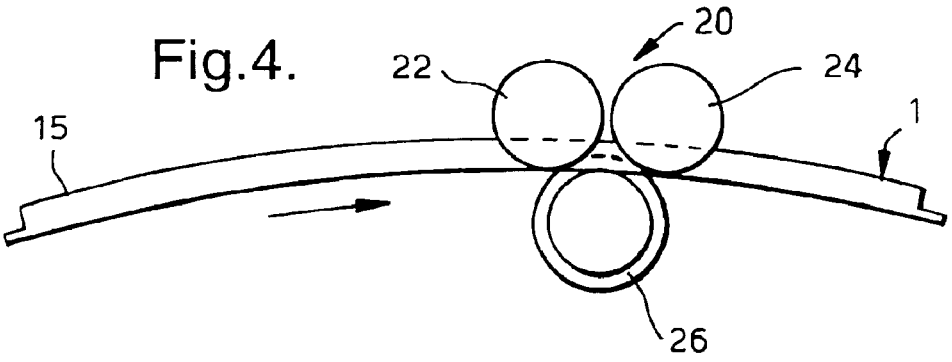
FIG. 4 is a schematic side view of a roll-forming machine, bending and curving the sheet of FIG. 3 to form the ceiling panel of FIG. 1.

FIG. 4 shows schematically a conventional roll-former 20 with three rollers 22, 24 and 26 which can longitudinally curve the flat metal sheet 15 of FIG. 3 and, optionally, at the same time bend its lateral margins in a conventional manner to form the ceiling panel 1 with its upstanding lateral side flanges 3 and its bevelled edge portions 7. It should be understood, however, that the transverse cross-section of the panel 1 with its upstanding flanges 3 is usually obtained in a separate roll-forming operation prior to the longitudinal bending of the panel into a concave or a convex curvature.

Figure 6:
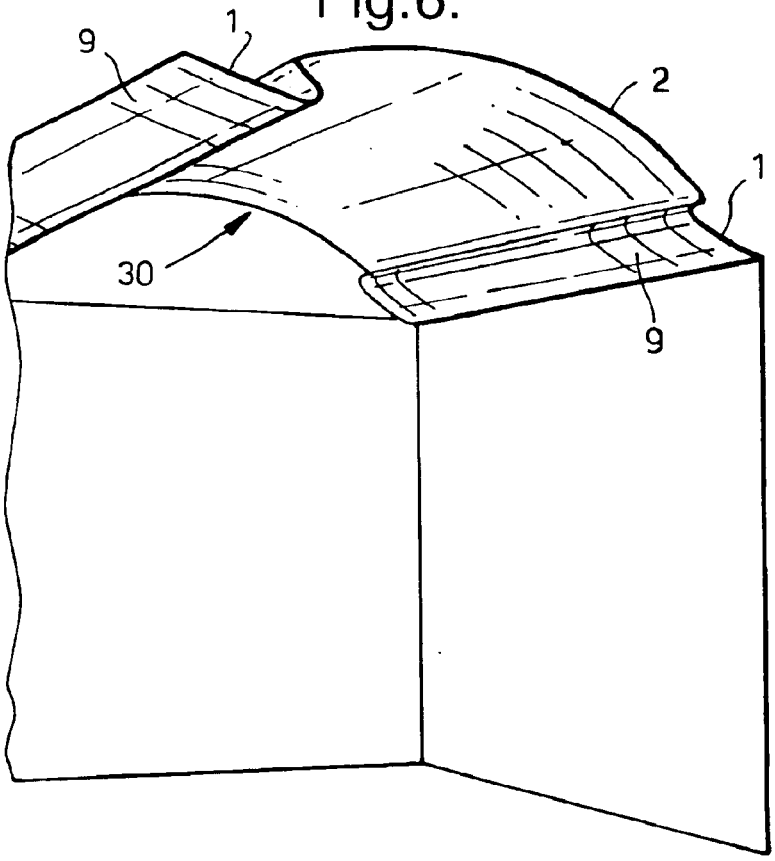
FIG. 6 is a perspective view of a multiple curved ceiling constructed of a plurality of curved ceiling panels.

FIG. 6 shows schematically a ceiling 30 made from longitudinally upwardly concave, ceiling panels 1 and corresponding, longitudinally upwardly convex, ceiling panels 2. The upstanding lateral side flanges 3 (not visible in FIG. 6) of each ceiling panel 1 and 2 are attached to conventional mounting brackets (not shown in FIG. 6) which can be used to suspend the ceiling panels.

Figure 7:
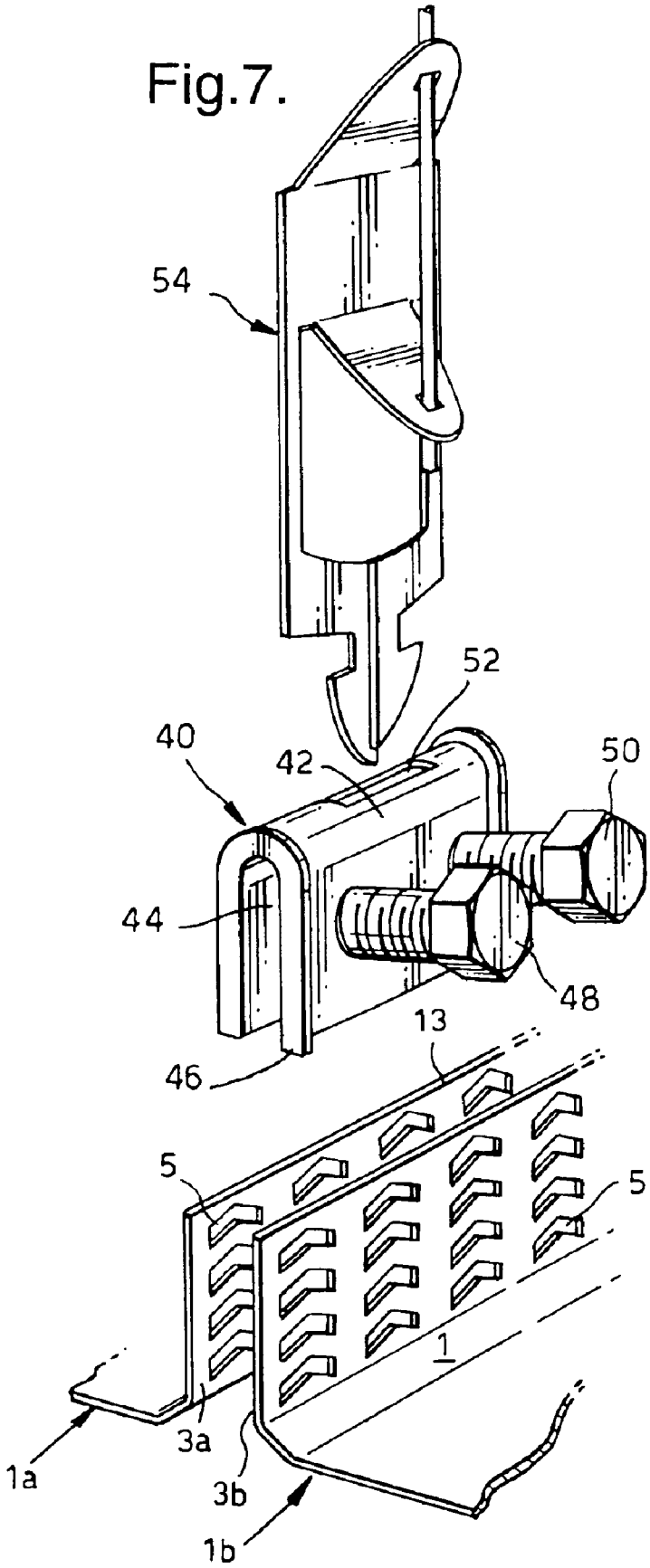
FIG. 7 is an exploded perspective view of a mounting bracket for connecting the upstanding lateral side flanges of two adjacent ceiling panels of FIG. 1 to a supporting structure (not shown)

FIG. 7 shows a mounting bracket 40 which can be used to suspend ceiling panels 1*a* and 1*b* having only closed apertures 5 from a conventional supporting structure (not shown). Surprisingly, the lateral side flanges 3 of the ceiling panel of this invention, despite their curvature, can be securely held and supported by the bracket 40. The bracket 40 has a generally inverted, U-shaped body 42 with a pair of downwardly directed, substantially parallel legs 44 and 46. Clamping screws 48 and 50 are received in one of the legs 46 and can be screwed towards and away from the other leg 44, so as to grip securely, between the screws 48 and 50 and the other leg 44, the flanges 3*a* and 3*b* of a pair of adjacent ceiling panels 1*a* and 1*b*. The web of the U-shaped body 42 is provided with a slot 52, which can be engaged by a conventional adjustable ceiling hanger 54 as described, for example, In GB 1 567 716. It is believed that the gripping force exerted on the flanges 3*a* and 3*b* by the clamping screws 48, 50 is substantially enhanced by the presence of the plurality of stress-reduction apertures 5 in the flanges. However, it is believed that the use of the bracket 40 is not limited to the curved ceiling panels of this invention and that it can also be used advantageously to hold straight ceiling panels on supporting structures.

Figure 8:
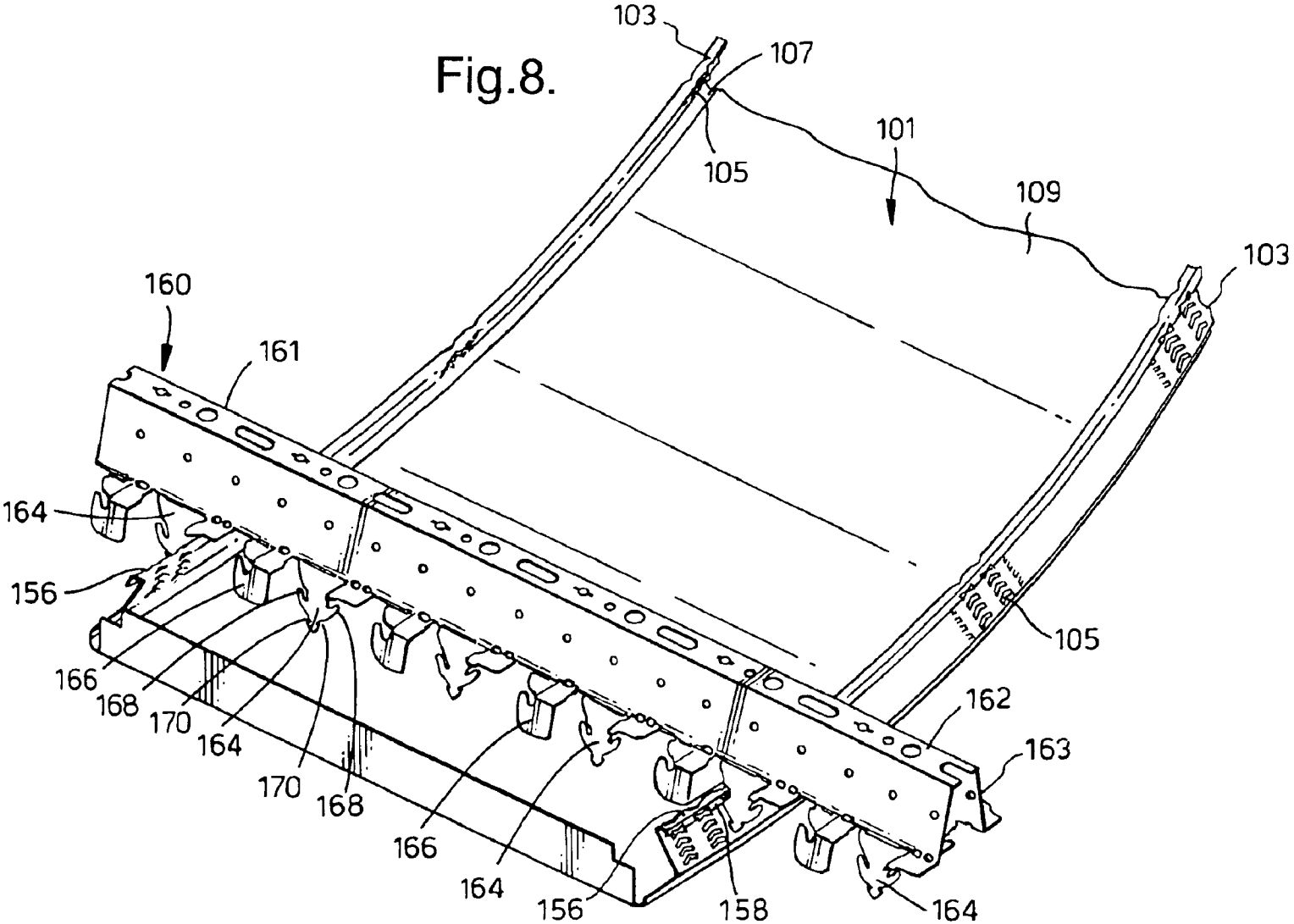
FIG. 8 is a perspective view of a second embodiment of a longitudinally-curved, upwardly concave, ceiling panel of the invention with outwardly turned beads, on its lateral side flanges, mounted on a support stringer.

FIG. 8 shows a second embodiment of an elongated, longitudinally curved, ceiling panel 101 of this invention which is similar to the ceiling panel 1 of FIGS. 1–7 and for which corresponding reference numerals (greater by 100) are used below for describing the corresponding parts.

The ceiling panel 101 has a pair of upturned lateral side flanges 103, connected by beveled edge portions 107 to opposite sides of its central portion 109. At the top of each lateral side flange 103 is an outwardly turned bead 156 with a downwardly turned rim 158 at the end of the bead 156. A plurality of stress-reduction open and closed apertures 105 of this invention, preferably with a generally V-shape, are provided in the lateral side flanges 103 and preferably also in their outwardly turned beads 156 and downwardly turned rims 158. In this regard, it is preferred that the stress-reduction apertures 105 be punched in the lateral margins of the flat metal sheet 15 of FIG. 3 before bending and curving the sheet into the ceiling panel 101, with its apertured flanges 103, beads 156 and rims 158, using, for example, the roll-former 20 of FIG. 4.

Preferably, each portion of each side flange 103 has at least one longitudinally-extending row of stress-reduction apertures 105. In this regard, each side flange 103, each bead 156 and each rim 158 contain a longitudinally-extending row of the stress-reduction apertures 105.

The ceiling panel 101 is mounted on a longitudinally elongate, first support stringer 160 such as is described in European patent 0 633 365. The first support stringer 160 has a body 161 having an inverted channel form with a central web 162 and two depending side flanges 163. Each side flange 163 is provided with a plurality of longitudinally spaced, first lugs 164, and each pair of these first lugs 164 has a second lug 166 interposed between the first lugs.

As seen in FIG. 8, the first support stringer 160 is a multi-purpose stringer, with two types of lugs 164, 166 that can support different types of ceiling panels of this invention. Each first lug 164 has a pair of upper lug hooks 168 on longitudinally opposite sides and a pair of lower lug hooks 170 on longitudinally opposite sides. The ceiling panel 101 can be installed by having the rim 158 on the bead 156 of each of its lateral side flanges 103 engage the upper or lower lug hooks 168, 170 of adjacent first lugs 164. In FIG. 8, the ceiling panel 101 is installed with the beads 156 on the rims 158 of its lateral side flanges 103 engaging the upper lug hooks 168 of the first support stringer 160.

Figure 9A:
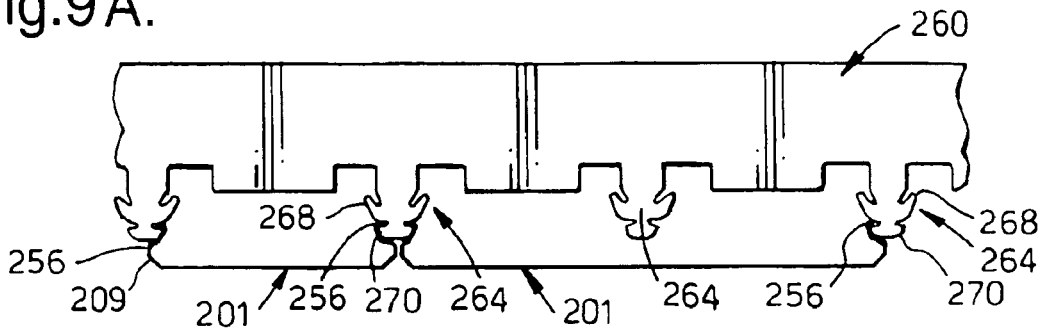
FIGS. 9A–9C are schematic views showing three further embodiments of curved ceiling panels of the invention, with outwardly and inwardly turned beads, on each of their lateral side flanges, mounted on a support stringer similar to that of FIG. 8.
Figure 9B:
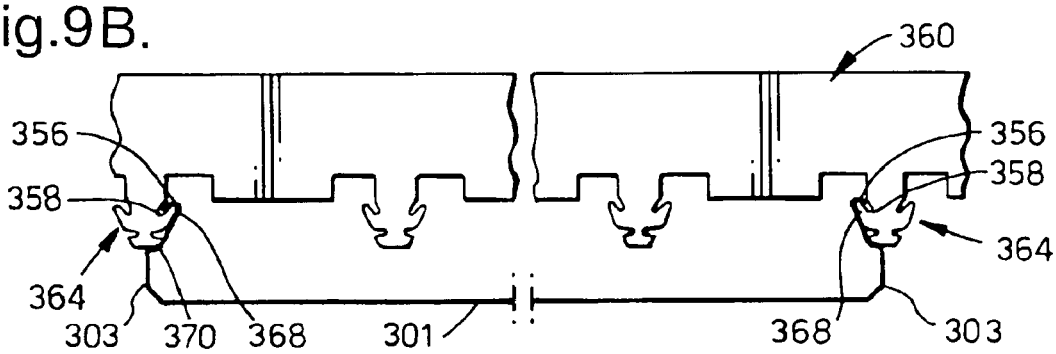
Figure 9C:
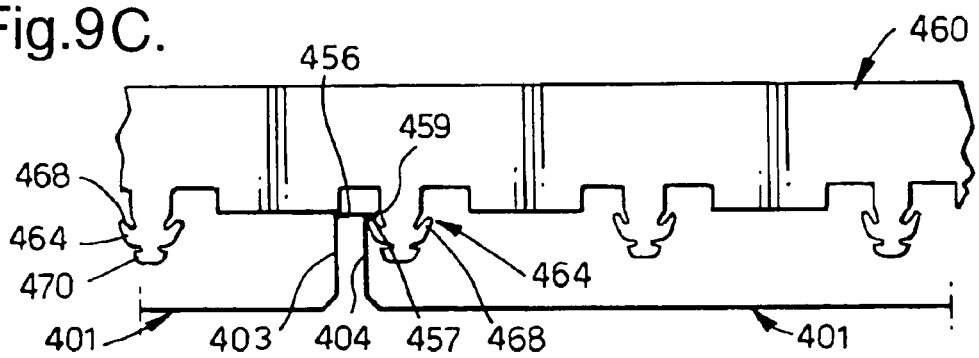

FIGS. 9A–9C show three further embodiments of elongated, longitudinally curved, ceiling panels 201, 301 and 401 of this invention which are similar to the ceiling panel 101 of FIG. 8 and for which corresponding reference numerals (greater by 100, 200 and 300, respectively) are used below for describing the corresponding parts.

Each ceiling panel 201, 301, 401 has a pair of upturned lateral side flanges 203, 303, 403. However, each ceiling panel 201 of FIG. 9A has only outwardly turned beads 256 on its lateral side flanges 203, with no downwardly turned rims; the ceiling panel 301 of FIG. 9B has outwardly turned beads 356 with downwardly turned rims 358 on both its lateral side flanges 303; and each ceiling panel 401 of FIG. 9C has an outwardly turned bead 456 with no downwardly turned rim on one of its lateral side flanges 403 and an inwardly turned bead 457 with a downwardly turned rim 459 on its other lateral side flange 404. Nevertheless, a plurality of stress-reduction apertures of this invention (not shown) are provided in the lateral side flanges and preferably also in their beads 256, 356, 456, 457 and rims 358, 459 of all of the ceiling panels 201, 301, 401. Moreover, all these ceiling panels 201, 301, 401 can be mounted on a second support stringer 260, 360, 460, respectively, of FIGS. 9A–9C as described below.

FIG. 9A shows a pair of adjacent ceiling panels 201 mounted on the second support stringer 260. The second support stringer 260 has only a plurality of first lugs 264 which are longitudinally spaced along the second stringer 260. Each first lug 264 has a pair of upper lug hooks 268 on longitudinally opposite sides and a pair of lower lug hooks 270 on longitudinally opposite sides. The ceiling panels 201 have the outwardly turned beads 256 on each of their lateral side flanges 203 engaged in one of the lower lug hooks 270 of the first lugs 264 of the second support stringer 260. In this regard, the bead 256 of the left flange 203 of one of the ceiling panels 201, in FIG. 9A, engages the right lower lug hook 270 of one of the first lugs 264, and bead 256 of the right flange 203 of the other ceiling panel 201 engages the left lower lug hook 270 of the same first lug 264.

FIG. 9B shows a single ceiling panel 301 mounted on a second support stringer 360, corresponding to the second support stringer 260 of FIG. 9A. The ceiling panel 301 has a pair of lateral side flanges 303 with outwardly turned beads 356 having downwardly turned rims 358. As shown in FIG. 9B, the ceiling panel 301 is installed with the rim 358 of the bead 356 of its left flange 303 engaging the right upper lug hook 368 of one of the first lugs 364 of the second support stringer 360 and with the rim 358 of the bead 356 of its right flange 303 engaging the left upper lug hook 368 of another first lug 364 of the second support stringer 360.

FIG. 9C shows adjoining portions of a pair of adjacent ceiling panels 401 mounted on a second support stringer 460, corresponding to the second support stringer 260 of FIG. 9A. Each ceiling panel 401, in FIG. 9C, has a right lateral side flange 403 with an outwardly turned bead 456 having no downwardly turned rim and a left lateral side flange 404 with an inwardly turned bead 457 having a downwardly turned rim 459. As shown in FIG. 9C, a first one of the adjoining ceiling panels 401 has the inwardly turned bead 457 and rim 459 of its left flange 404 engaging the left upper lug hook 468 of one of the first lugs 464 of the second support stringer 460, and a second one of the adjoining ceiling panels 401 has the outwardly turned bead 456 of its right flange 403 resting on top of the inwardly turned bead 457 of the left flange 404 of the first ceiling panel 401 and also resting on top of the left upper lug hook 468 of the same first lug 464 of the second support stringer 460. Effectively, the adjoining right and left flanges 403, 404 of the two adjacent ceiling panels 401 are thereby mounted on a single upper lug hook 468 of one of the first lugs 464 of the second support stringer 460.

Figure 10:
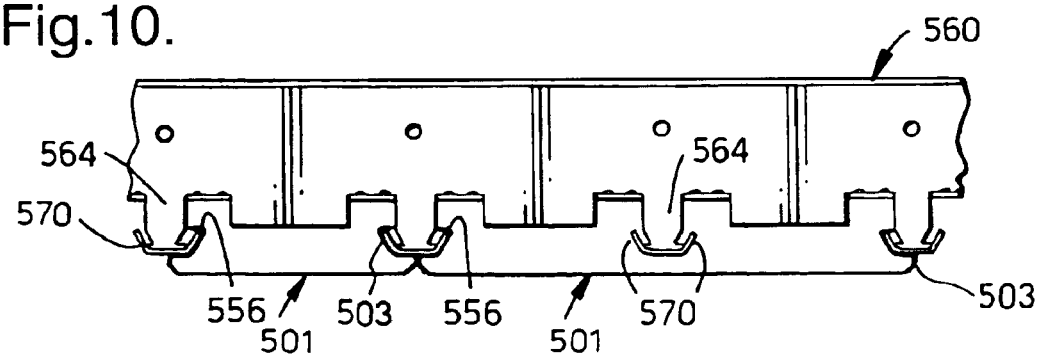
FIG. 10 is a schematic view of a still further embodiment of a curved ceiling panel of the invention, mounted on a support stringer different from that of FIGS. 8 and 9A–9C.

FIG. 10 shows a still further embodiment of an elongated, longitudinally curved, ceiling panels 501 of this invention which is similar to the ceiling panel 101 of FIG. 8 and for which corresponding reference numerals (greater by 400) are used below for describing the corresponding parts.

In FIG. 10, a pair of adjacent ceiling panels 501 are mounted on a third support stringer 560. Each ceiling panel 501 has a pair of upstanding lateral side flanges 503, on top of which are outwardly turned beads 556 without downwardly turned rims. A plurality of stress-reduction apertures of this invention (not shown) are provided in the lateral side flanges 503 and preferably the beads 556 of the ceiling panels 501.

The third support stringer 560, shown in FIG. 10, has different first lugs 564 from those of the first and second, support stringers of FIGS. 8 and 9A–9C. In this regard, the bottom of each first lug 564 is generally U-shaped and forms a pair of lower lug hooks 570 on longitudinally opposite sides of the first lug 564. Thus, the outwardly turned beads 556 on the lateral side flanges 503 of the ceiling panels 501 engage the lower lug hooks 570 of the third support stringer 560.

Figure 11:
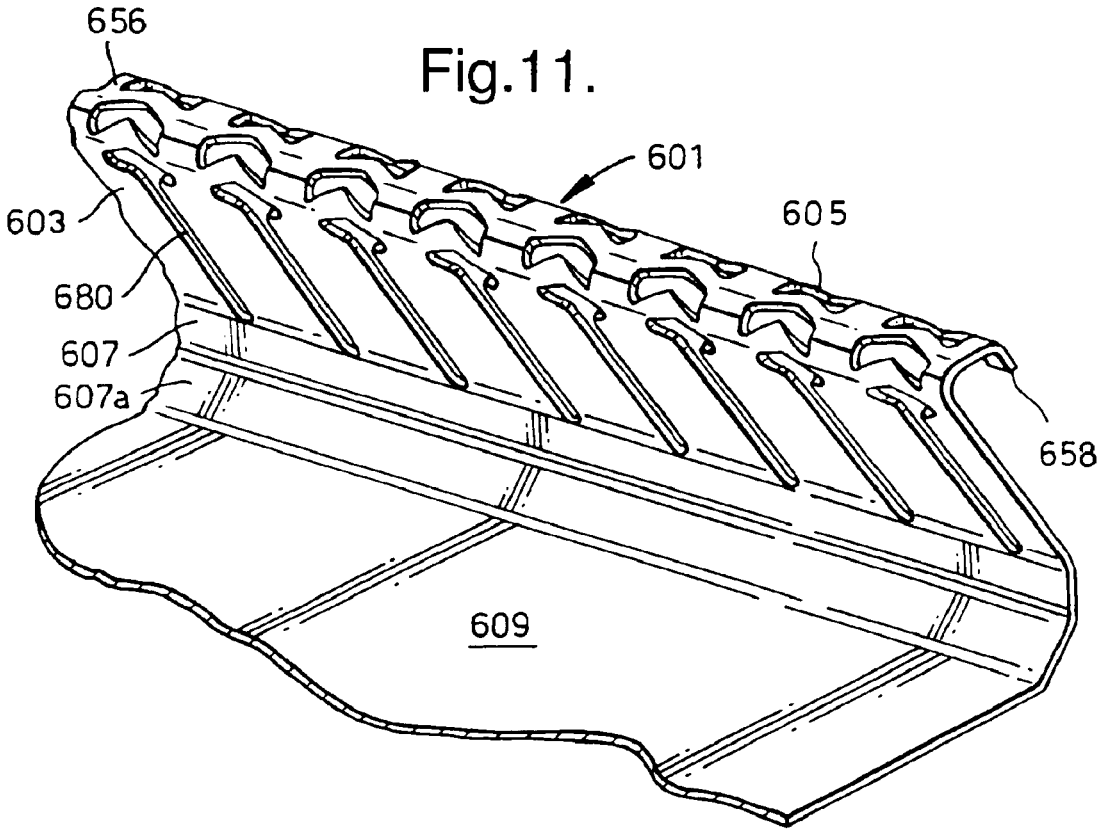
FIG. 11 is a perspective view of a portion of yet another embodiment of a longitudinally-curved ceiling panel of the invention (looking laterally outwardly of the panel) with outwardly turned beads on its lateral side flanges.
Figure 12:
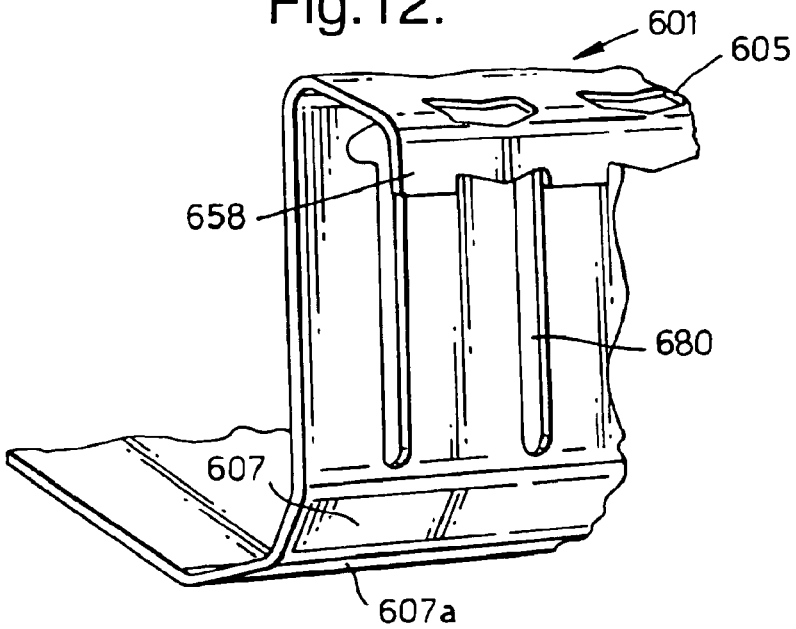
FIG. 12 is a perspective view of a portion of the longitudinally-curved ceiling panel of FIG. 11 (looking laterally inwardly of the panel)

FIGS. 11 and 12 show yet another embodiment of an elongated, longitudinally curved, ceiling panel 601 of this invention which is similar to the ceiling panel 101 of FIG. 8 and for which corresponding reference numerals (greater by 500) are used below for describing the corresponding parts.

Figure 13:
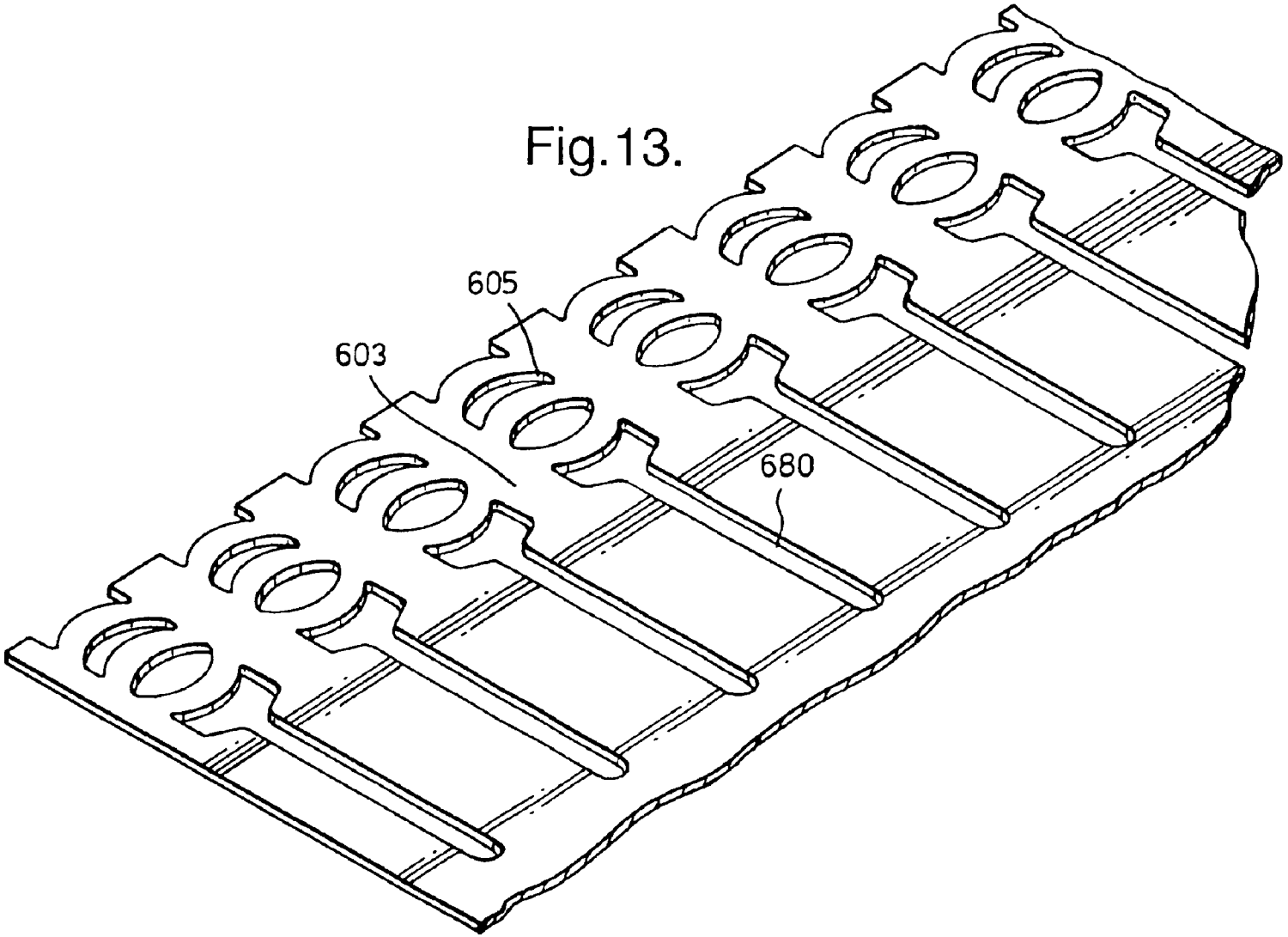
FIG. 13 is a top plan view of a portion of a metal sheet with punched-out stress-reduction apertures in its lateral margins, prior to bending and curving the sheet to form the ceiling panel of FIG. 11.

The ceiling panel 601 has a pair of upturned lateral side flanges 603. At the top of each lateral side flange 603 is an outwardly turned bead 656 with a downwardly turned rim 658 at the end of the bead 656. A plurality of stress-reduction apertures 605 of this invention, preferably with a generally V-shape, are provided in the lateral side flanges 603 and preferably also in their outwardly turned beads 656 and downwardly turned rims 658. In this regard, it is preferred that the stress-reduction apertures 605 be punched in the lateral margins of the flat metal sheet 615 of FIG. 13 before bending and curving the sheet into the ceiling panel 601, with its apertured flanges 603, beads 656 and rims 658, using, for example, the roll-former 20 of FIG. 4.

Preferably, each portion of each side flange 603 has at least one longitudinally-extending row of stress-reduction apertures 605. In this regard, each side flange 603, each bead 656 and each rim 658 contain a longitudinally-extending row of the apertures 605.

It is also preferred that the lowest longitudinally-extending row of stress-reduction aperture 605 in each side flange 603 be provided with elongated slots 680. Each slot 680 extends downwardly from the bottom of an aperture 605 towards the central portion 609 of the ceiling panel 601. The length and width of each slot 680 are not critical. Preferably, the width of each slot 680 is a minimum, and the length of each slot preferably extends nearly all the way to the bottom of its side flange 603, to the bevelled edge portions 607 and 607*a* between the side flange and the central portion 609 of the ceiling panel 601, provided the slots 680 are not visible when looking at the central portion of the ceiling panel, as installed.

Figure 14B:
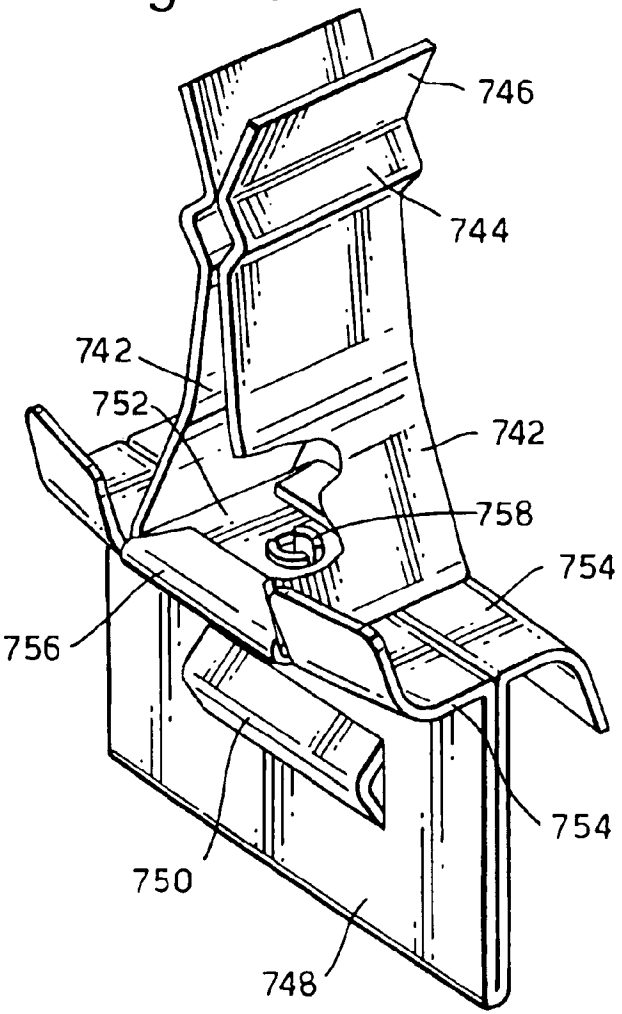
FIGS. 14(*a*) and (*b*) are exploded perspective views of another mounting bracket for connecting the upstanding lateral side flanges of two adjacent ceiling panels of FIG. 1 to a supporting structure.
Figure 14A:
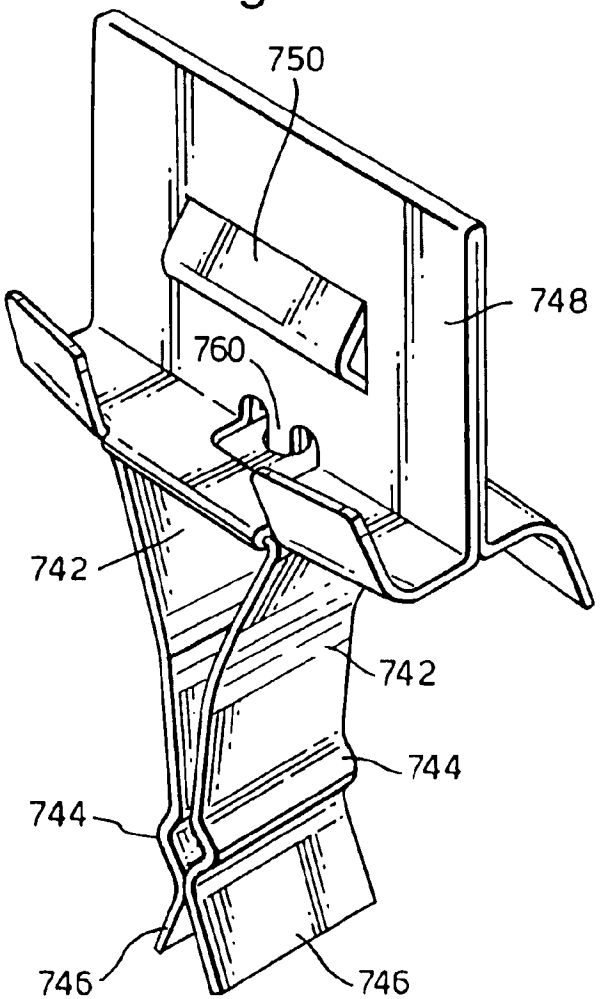

FIGS. 14(*a*) and (*b*) illustrate another embodiment of a mounting bracket 740. This is illustrated schematically in FIG. 15 connecting the upstanding lateral side flanges 703*a* and 703*b* of two adjacent ceiling panels 701 and 701*a* to a supporting structure 706.

The mounting brackets 740 includes two downwardly extending legs 742 which are resiliently biased towards one another. The legs include recessed portions 744 and lips 746. In use, the legs 742 are pushed over two adjacent lateral side flanges 703*a* and 703*b* so that the side flanges 703*a* and 703*b* are gripped between the legs 742.

Figure 15:
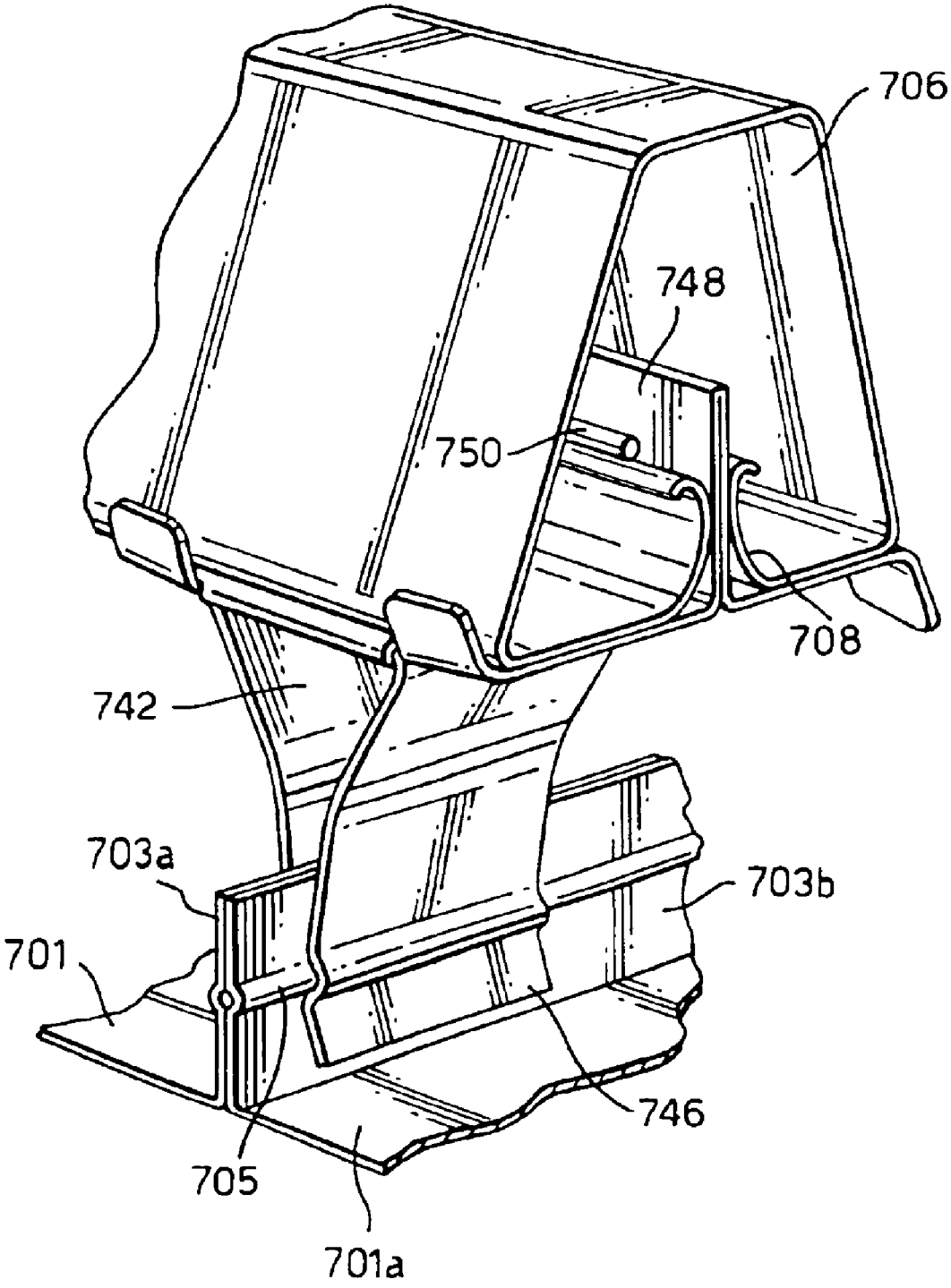
FIG. 15 is a view of the mounting bracket of FIGS. 14(*a*) and (*b*) connecting two adjacent ceiling panels.

Preferably, and as illustrated in FIG. 15, the lateral side flanges 703*a* and 703*b* are formed with elongate deflections 705 along their length. This deflection 705 provides a longitudinally extending ridge or groove along each side flange. Alternatively, the deflections 705 could be replaced by a series of discrete dimples.

When the side flanges 703*a*,703*b* are pushed between the legs 742, the outwardly sloping lips 746 are deflected by the deflection 705 so as to open the legs 742. The deflection 705 then fits into the recess 744 so as to hold the ceiling panels securely in place. In this respect, it will be appreciated that it is not necessary for the legs 742 to have a recess 744 as such. In fact, it is only necessary for the legs 742 to include an inward abutting deflection which can be located beneath the deflection 705.

As illustrated in FIG. 15, the mounting brackets 740 may be supported by a support structure 706.

The mounting bracket 740 has an upwardly extending plate section 748 with an elongate protrusion 750. Where, as is preferred, the mounting bracket is produced from metal plate, the plate 748 may comprise a single plate folded over and the protrusion 750 provided as a section pressed out from each part of the plate 748.

The support structure 706 includes an elongate channel having inwardly extending arms 708 which are resiliently biased towards one another. Hence, as illustrated, the plate 748 of the mounting bracket 740 may be pushed up between the arms 708 with the arms 708 gripping the plate 748 below the protrusion 750 and the mounting bracket 740 held in place by the protrusion 750.

As illustrated in FIG. 14*b* the two arms 742 may be formed from a single sheet of metal and are joined by a base 752. Each half of the plate 748 has a flange 754 and each flange 754 includes a tab 756 which is folded over the base 752 to hold it in place.

Since the two halves of the plate 748 will have a tendency to spring apart, there might be a danger of the tabs 756 separating and releasing the base 752. Therefore, the base 752 is provided with an aperture 758 and each half of the plate 748 has a tongue 760 which extends into the aperture 758. In this way, the two halves of the plate 748 are prevented from separating.

Alternatively, instead of providing the tabs 756, the base 752 can include tabs on its sides which are bent over the flanges 754 of the plate 748. In this case, the tabs of the base 752 will themselves hold the two halves of the plate 748 together such that the aperture 758 and tongues 760 are unnecessary.

This invention is, of course, not limited to the above-described embodiments which can be modified without departing from the scope of the invention or sacrificing all of its advantages. In this regard, the terms in the foregoing description and the following claims, such as "upstanding", "upwardly", "downwardly", "left", "right", "height", "vertically", "laterally", "longitudinally", "bottom" and "top" have been used only as relative terms to describe the relationships of the various elements of the curved ceiling panel, the method of making it and the bracket for mounting it of this invention. For example, the longitudinally curved building panel of this invention can be mounted on a wall, as well as on a ceiling, in accordance with this invention.

What is claimed is:

1. A method of providing stress relief in an elongated longitudinally curved panel having a central portion and at least one upstanding longitudinally extending side flange comprising the steps of:

providing an elongated panel having a central portion and a longitudinally extending zone of material, forming closed apertures fully within said longitudinally extending zone of said panel, bending said zone relative to said central portion so that said apertures remain closed, and curving the panel longitudinally.

2. The method of claim 1 wherein said zone is bent relative to said central portion prior to the panel being curved longitudinally.

3. The method of claim 1 wherein said apertures are formed by punching the apertures in the panel.

4. The method of claim 1 further including the step of forming some open apertures in said zone prior to bending said zone relative to said central portion.

5. The method of claim 1 wherein said closed apertures have a shape selected from the group consisting of V-shaped, Y-shaped, X-shaped, U-shaped, W-shaped, M-shaped, triangular-shaped, diamond-shaped and half-moon crescent shaped.

6. The method of claim 1 wherein said zone is bent to be perpendicular to said central zone.

7. The method of claim 1 wherein there are two zones, one on either side of said central zone.

8. The method of claim 1 wherein said central portion intersects with said zone along a line of intersection and said line of intersection is curved in a longitudinally extending direction.

9. The method of claim 1 wherein said panel is bent with rollers.

10. The method of claim 1 wherein said apertures in said zone form a plurality of parallel, laterally-extending columns, spaced apart along the longitudinal length of the zone.

11. The method of claim 1 wherein said zone is bent relative to said central portion into a single layer.

* * * * *